US010359725B2

(12) United States Patent
Ota

(10) Patent No.: US 10,359,725 B2
(45) Date of Patent: Jul. 23, 2019

(54) POWER SOURCE DEVICE AND IMAGE FORMING APPARATUS

(71) Applicant: FUJI XEROX CO., LTD., Tokyo (JP)

(72) Inventor: Daisuke Ota, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/945,805

(22) Filed: Apr. 5, 2018

(65) Prior Publication Data

US 2019/0094779 A1 Mar. 28, 2019

(30) Foreign Application Priority Data

Sep. 27, 2017 (JP) ..... 2017-187107

(51) Int. Cl.
*G05F 1/40* (2006.01)
*G03G 15/00* (2006.01)

(52) U.S. Cl.
CPC ..... *G03G 15/5004* (2013.01); *G03G 15/80* (2013.01)

(58) Field of Classification Search
CPC ..... G05F 1/00; G05F 1/10; G05F 1/12; G05F 1/40; G05F 1/563; G05F 1/61; G05F 1/614; G03F 3/10; G05G 15/06; G03G 15/065; G03G 15/5004; G03G 15/80
See application file for complete search history.

(56) References Cited

U.S. PATENT DOCUMENTS 6,696,898 B1 * 2/2004 Ward ..... H01F 17/0006 257/E27.046
9,882,426 B2 * 1/2018 Kim ..... H02J 17/00
9,950,518 B2 * 4/2018 Yamada ..... B41J 2/04541
9,956,766 B2 * 5/2018 Yamada ..... B41J 2/04541
2010/0088534 A1 * 4/2010 Watanabe ..... G06K 19/0701 713/340
2012/0039651 A1 * 2/2012 Yamaguchi ..... B41J 3/4075 400/613
2014/0152251 A1 * 6/2014 Kim ..... H02J 7/025 320/108

FOREIGN PATENT DOCUMENTS

JP 2010-124677 A 6/2010
JP 2013-065932 A 4/2013
JP 5282580 B2 9/2013

* cited by examiner

*Primary Examiner* — Adolf D Berhane
(74) *Attorney, Agent, or Firm* — Sughrue Mion, PLLC

(57) ABSTRACT

A power source device includes a control substrate and a power source substrate. The control substrate has a modulation signal generating integrated circuit that outputs a modulation signal modulated to generate an AC voltage. The power source substrate generates a high AC voltage by demodulating the modulation signal which is output from the modulation signal generating integrated circuit of the control substrate.

10 Claims, 9 Drawing Sheets

POWER SOURCE DEVICE AND IMAGE FORMING APPARATUS

CROSS-REFERENCE TO RELATED APPLICATIONS

This application is based on and claims priority under 35 USC 119 from Japanese Patent Application No. 2017-187107 filed Sep. 27, 2017.

BACKGROUND

Technical Field

The present invention relates to a power source device and an image forming apparatus.

SUMMARY

According to an aspect of the present invention, there is provided a power source device including: a control substrate that has a modulation signal generating integrated circuit that outputs a modulation signal modulated to generate an AC voltage; and a power source substrate that generates a high AC voltage by demodulating the modulation signal which is output from the modulation signal generating integrated circuit of the control substrate.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

First Exemplary Embodiment

Figure 1:
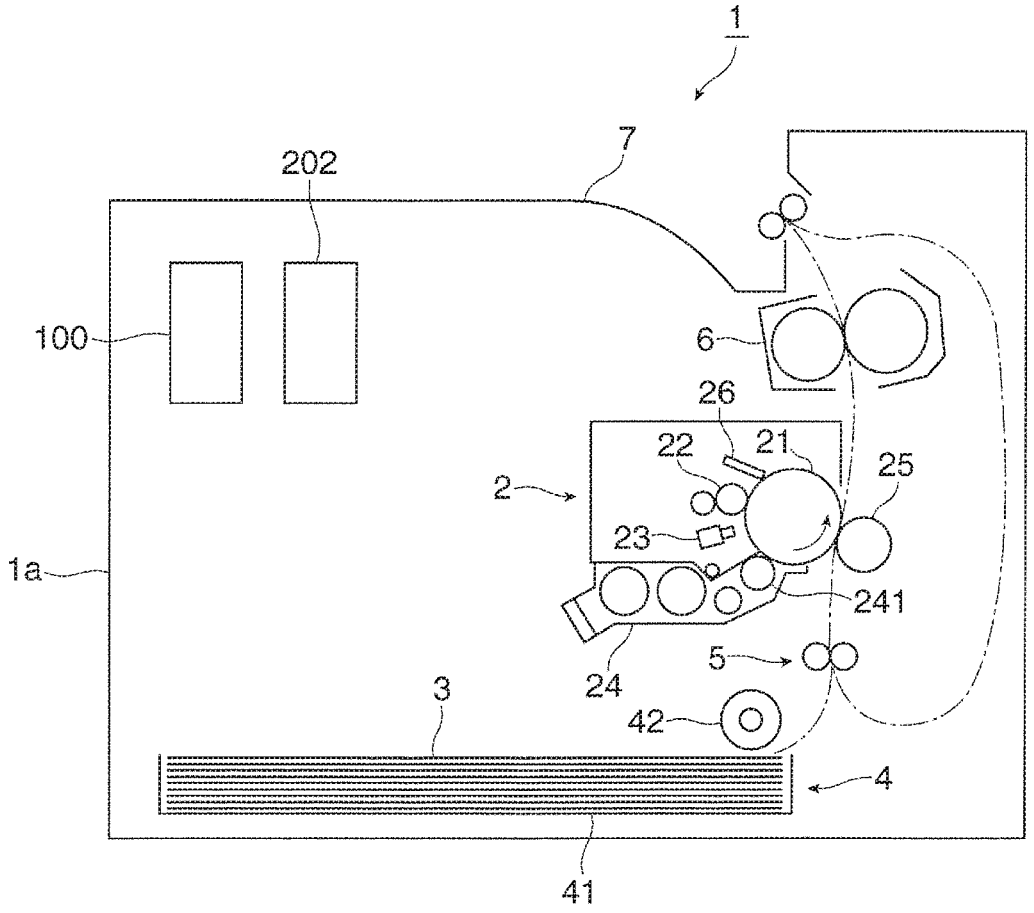
FIG. 1 illustrates a schematic configuration of an image forming apparatus including a power source device according to a first exemplary embodiment of the present invention.

FIG. 1 illustrates an overview of the entire image forming apparatus including a power source device according to a first exemplary embodiment.

<Overall Configuration of Image Forming Apparatus>

An image forming apparatus 1 according to the first exemplary embodiment is constituted as a monochrome printer, for example. The image forming apparatus 1 includes an image forming section 2, a paper feed section 4, a transport section 5, a fixing section 6, etc. The image forming section 2 forms a toner image (image) to be developed using a toner that constitutes a developer. The paper feed section 4 supplies the image forming section 2 with recording paper 3 that serves as an example of a recording medium. The transport section 5 transports the recording paper 3, which is supplied from the paper feed section 4 one sheet at a time, to the image forming section 2, etc. The fixing section 6 performs a fixing process on the recording paper 3 on which the toner image has been formed by the image forming section 2.

The image forming section 2 forms an image on a surface of the recording paper 3 through an electrophotographic process in which a developer is used. The image forming section 2 includes a photoconductor drum 21, a charging device 22, an exposure device 23, a developing device 24, a transfer device 25, a cleaning device 26, etc. The photoconductor drum 21 serves as an example of an image holding member. The charging device 22 charges the peripheral surface of the photoconductor drum 21. The exposure device 23 exposes the photoconductor drum 21 to light to form an electrostatic latent image. The developing device 24 supplies the developer to the electrostatic latent image of the photoconductor drum 21 to develop the electrostatic latent image using a developing roller 241. The transfer device 25 transfers the toner image which is formed on the photoconductor drum 21 to the recording paper 3. The cleaning device 26 cleans the peripheral surface of the photoconductor drum 21. A charging voltage is supplied to the charging device 22. In the case where the developing device 24 performs reversal development, a DC voltage having the same polarity as the polarity for charging the toner which is supplied from the developing device 24, or a charging bias voltage obtained by superposing an AC voltage as necessary on a current, is supplied as the charging voltage by a power source device (not illustrated). In addition, a developing bias voltage obtained by superposing an AC voltage on a DC voltage is supplied by a power source device (not illustrated) to the developing device 24 between the developing roller 241 and the photoconductor drum 21. The transfer device 25 may transfer the toner image to the recording paper 3 via an intermediate transfer body such as an intermediate transfer belt, rather than directly transferring the toner image from the photoconductor drum 21 to the recording paper 3. The developer contains a black toner, for example. The developer may also contain color toners such as yellow, magenta, and cyan, besides the black color.

The paper feed section 4 includes a container 41, a paper feed roller 42, etc. The container 41 stores the recording paper 3. The paper feed roller 42 feeds the recording paper 3 from the container 41 one sheet at a time. The paper feed section 4 is able to supply the recording paper 3 which is stored in the container 41 with the container 41 installed in an apparatus body 1*a* of the image forming apparatus 1. The container 41 is attached so as to be drawn out toward the front surface (a side surface that a user faces during operation) of the apparatus body 1*a*, that is, toward the left side surface in the illustrated example, for example.

The transport section 5 transports the recording paper 3 which is fed from the paper feed section 4 to the image forming section 2 and the fixing section 6, and transports the recording paper 3, on which an image has been formed, so as to be ejected to an eject section 7 which is installed at the upper portion of the apparatus body 1*a*. When forming a double-sided image, the transport section 5 does not eject the recording paper 3, on one surface of which an image has been formed, to the eject section 7, but transports such recording paper 3 again to the image forming section 2 with the front and back sides of the recording paper 3 reversed.

The fixing section 6 fixes the toner image, which is formed on the surface of the recording paper 3 by the image forming section 2, to the recording paper 3 by melting the toner image using heat and a pressure. The eject section 7 ejects the recording paper 3, to which an image has been fixed by the fixing section 6, to store a stack of sheets of the recording paper 3.

In FIG. 1, reference numeral 100 denotes a control device that comprehensively controls operation of the image forming apparatus 1.

Figure 2:
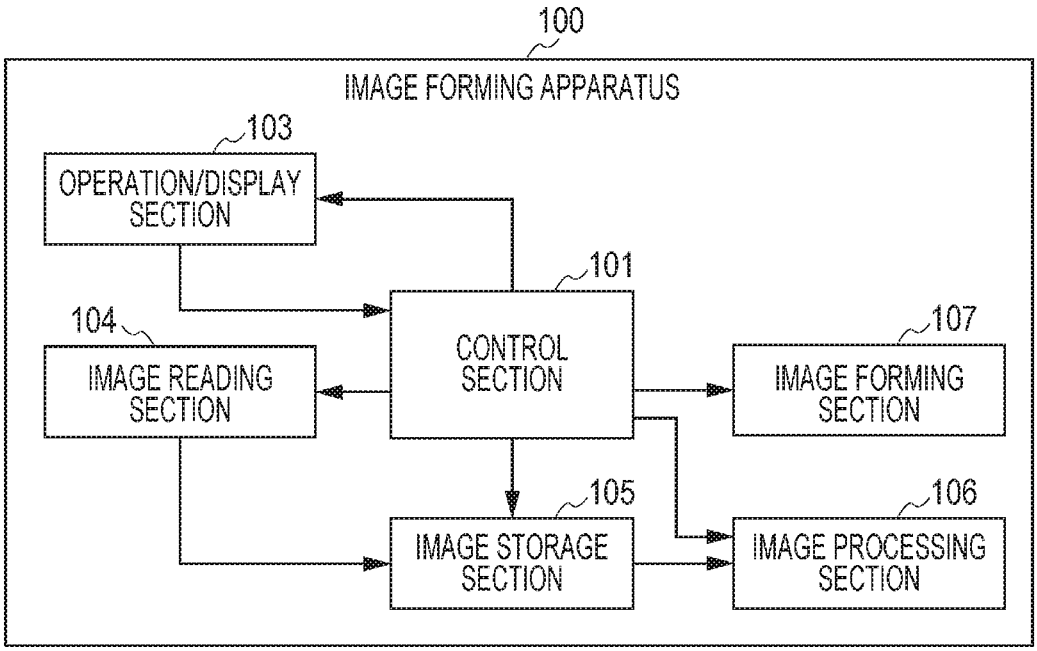
FIG. 2 is a block diagram illustrating a control device of the image forming apparatus according to the first exemplary embodiment of the present invention.

FIG. 2 is a block diagram illustrating a control device 100 of the image forming apparatus according to the exemplary embodiment.

In FIG. 2, reference numeral 101 denotes a control section that serves as a control unit that comprehensively controls operation of the entire image forming apparatus 1. The control section 101 includes an image forming function control substrate (micro controller unit (MCU)). The control section 101 is a microprocessor formed by integrating computer systems in a single integrated circuit. The control section 101 includes a control integrated circuit (IC), a storage unit such as a read only memory (ROM) and a random access memory (RAM), a bus that connects the CPU, the ROM, etc., a communication interface, etc.

Reference numeral 103 denotes an operation/display section composed of a user interface or the like including a display section composed of a liquid crystal display panel or the like and operated by the user to input image forming conditions, such as the size of the recording paper 3 and the number of sheets to be printed, to the image forming apparatus 1.

Reference numeral 104 denotes an image reading section that reads an image of a document in the case where the image forming apparatus 1 functions as a copier. Reference numeral 105 denotes an image storage section that temporarily stores image information (data) read by the image reading section 104 or sent from the outside. Reference numeral 106 denotes an image processing section that performs predetermined image processing on the image data which are stored in the image storage section 105. Reference numeral 107 denotes an image forming section (printing section) that serves as an image forming unit that performs image forming (printing) operation on the basis of the image data on which the predetermined image processing has been performed by the image processing section 106.

<Configuration of Power Source Device of Image Forming Apparatus>

Figure 3:
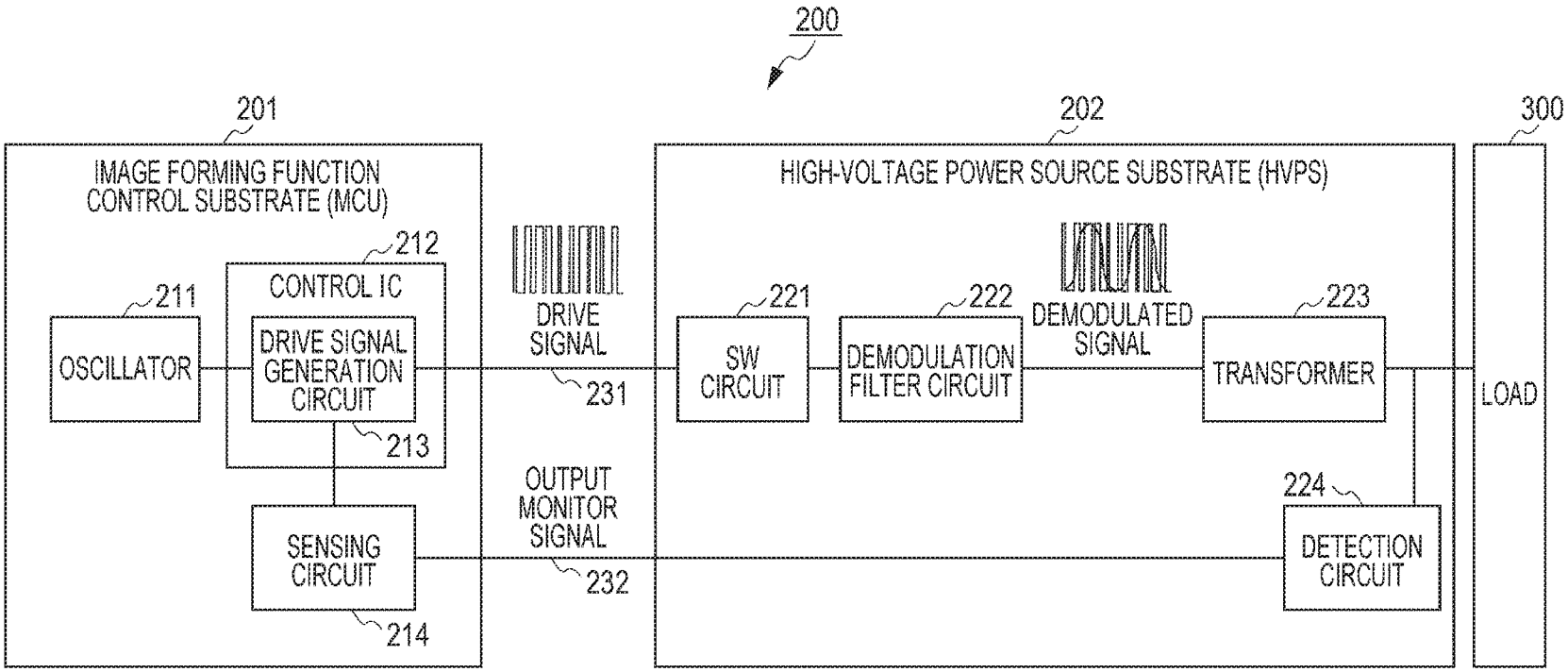
FIG. 3 is a block diagram illustrating the power source device according to the first exemplary embodiment of the present invention.

As illustrated in FIG. 3, a power source device 200 includes an image forming function control substrate (MCU) 201 and a high-voltage power source substrate 202. The image forming function control substrate 201 serves as an example of a control substrate of the control section 101. The high-voltage power source substrate 202 serves as an example of a power source substrate. The image forming function control substrate (MCU) 201 includes an oscillator 211 that generates a signal at a frequency corresponding to a drive signal. A reference clock signal output from the oscillator 211 may be a signal at 50 MHz, 100 MHz, etc. The reference signal which is output from the oscillator 211 is input to a control integrated circuit (IC) 212 that serves as an example of the single integrated circuit. The control IC 212 includes a drive signal generation circuit 213 that is built therein and that serves as a functional circuit implemented by the control IC 212. The drive signal generation circuit 213 outputs a drive signal, which is a pulse width modulation (PWM) signal, to the high-voltage power source substrate 202. The high-voltage power source substrate 202 is disposed in the image forming section 107, for example. However, the high-voltage power source substrate 202 may be disposed in an apparatus body 1*a* of another image forming apparatus 1.

Figure 4A:
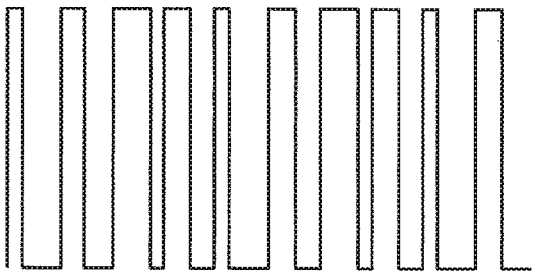
FIGS. 4A to 4D are each a waveform chart illustrating a PWM signal.
Figure 4B:
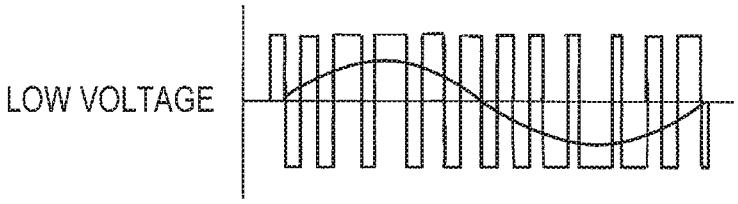
Figure 4C:
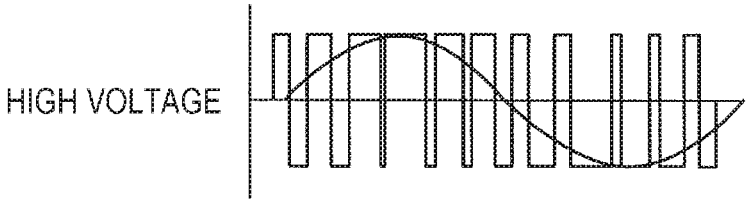
Figure 4D:
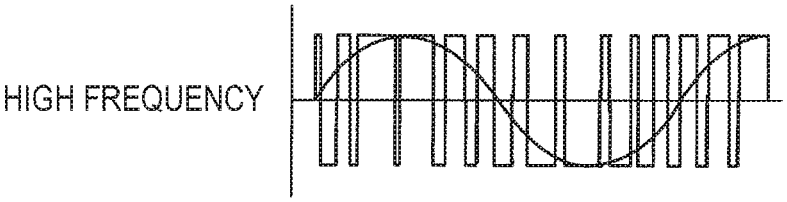

The drive signal is a signal having a constant amplitude and modulated such that a pulse width differs in accordance with the output voltage value and the frequency as illustrated in FIG. 4A. For a relatively low voltage, as illustrated in FIG. 4B, the difference in pulse width of the drive signal between the positive polarity and the negative polarity is small. For a relatively high voltage, meanwhile, as illustrated in FIG. 4C, the difference in pulse width of the drive signal between the positive polarity and the negative polarity is large. For a relatively high frequency, further, as illustrated in FIG. 4D, the cycle at which the pulse width of the drive signal is varied between the positive polarity and the negative polarity is short.

Such a drive signal is generated so as to correspond to a sinusoidal wave, a triangular wave, or a rectangular wave, for example. The frequency of the drive signal is decided on the basis of the signal at the reference frequency which is output from the oscillator 211. It should be noted, however, that the frequency of the drive signal is not necessarily equal to the reference frequency of the signal which is output from the oscillator 211.

The high-voltage power source substrate 202 of the image forming section 107 roughly includes a switching (SW) circuit 221, a demodulation filter circuit 222, a transformer 223 for voltage boost, and a detection circuit 224 that detects an output voltage. The switching circuit 221 amplifies the drive signal, which is a PWM signal, which is input from the image forming function control substrate (MCU) 201. The drive signal which is a PWM signal amplified by the switching circuit 221 is input to the demodulation filter circuit 222.

The demodulation filter circuit 222 is a circuit that demodulates the drive signal, which has been PWM-modulated and amplified by the switching circuit 221, to generate a signal composed of a sinusoidal wave as originally, a triangular wave, or the like. The demodulation filter circuit 222 is constituted of a low-pass filter (LPF), etc., for example. The low-pass filter is a filter that hardly attenuates components at a frequency that is lower than the cutoff frequency, but that decreases components at a frequency that is higher than the cutoff frequency. The demodulation filter circuit 222 generates an AC waveform such as a sinusoidal wave, a rectangular wave, or a triangular wave on the basis of the drive signal. The AC waveform which is generated by the demodulation filter circuit 222 is input to the transformer 223.

The transformer 223 boosts the AC waveform signal, which has been demodulated by the demodulation filter circuit 222, to a predetermined voltage value. The high AC voltage which has been boosted by the transformer 223 is supplied to a load 300. Examples of the load 300 include the charging device and the developing device of the image forming apparatus 1. It is a matter of course, however, that the load 300 is not limited to the charging device and the developing device of the image forming apparatus 1. In the exemplary embodiment, the output voltage of the transformer 223 is supplied as it is to the load 300. However, the output voltage of the transformer 223 may be supplied to the load 300 after being rectified into a DC voltage via a rectification circuit (not illustrated). Further, a DC voltage rectified via a rectification circuit (not illustrated) may be superposed on the output voltage of the transformer 223 to be supplied to the load 300.

The high AC voltage which has been boosted by the transformer 223 is also input to the detection circuit 224. The detection circuit 224 is constituted of a voltage detection circuit that detects a voltage value of the high AC voltage to be output to the load 300. A detection signal from the detection circuit 224 is input to the image forming function control substrate (MCU) 201 as an output monitor signal.

The image forming function control substrate (MCU) 201 has a sensing circuit 214 composed of an analog/digital (A/D) converter that converts the output monitor signal, which is an analog signal, into a digital signal, etc. The output monitor signal which has been converted into a digital signal by the sensing circuit 214 is input to the drive signal generation circuit 213 of the control IC 212. The drive signal generation circuit 213 controls the drive signal to be generated such that the output voltage of the output monitor signal is equal to a target value.

<Operation of Power Source Device of Image Formation Apparatus>

In the first exemplary embodiment, as illustrated in FIG. 3, a high AC voltage is supplied from the power source device 200 to the charging device 22, the developing device 24, etc. of the image forming apparatus 1 during image forming operation.

Figure 5A:
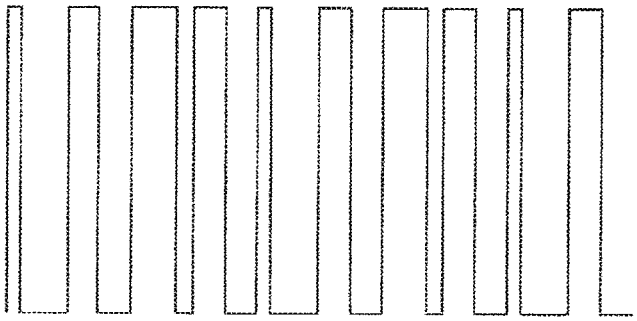
FIGS. 5A and 5B are waveform charts illustrating a PWM signal and a demodulated signal, respectively.
Figure 5B:
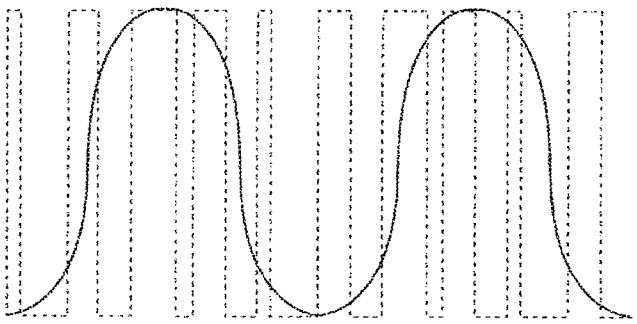

In the power source device 200, as illustrated in FIG. 3, the drive signal generation circuit 213 of the control IC 212 generates a drive signal, which is a PWM signal, along with the start of the image forming operation. The drive signal which is output from the drive signal generation circuit 213 of the control IC 212 which is provided in the image forming function control substrate (MCU) 201 is input to the switching circuit 221 of the high-voltage power source substrate 202 via a signal line 231. The drive signal is amplified by the switching circuit 221, and thereafter input to the demodulation filter circuit 222 to be demodulated into a sinusoidal wave signal or the like as illustrated in FIG. 5B.

The sinusoidal wave signal which has been demodulated by the demodulation filter circuit 222 is boosted to a predetermined high voltage by the transformer 223, and output to the load 300 as a high AC voltage.

In this way, it is only necessary that the power source device 200 according to the first exemplary embodiment described above should include only one control IC 212 as an integrated circuit that constitutes the power source device 200.

Comparative Example

Figure 6:
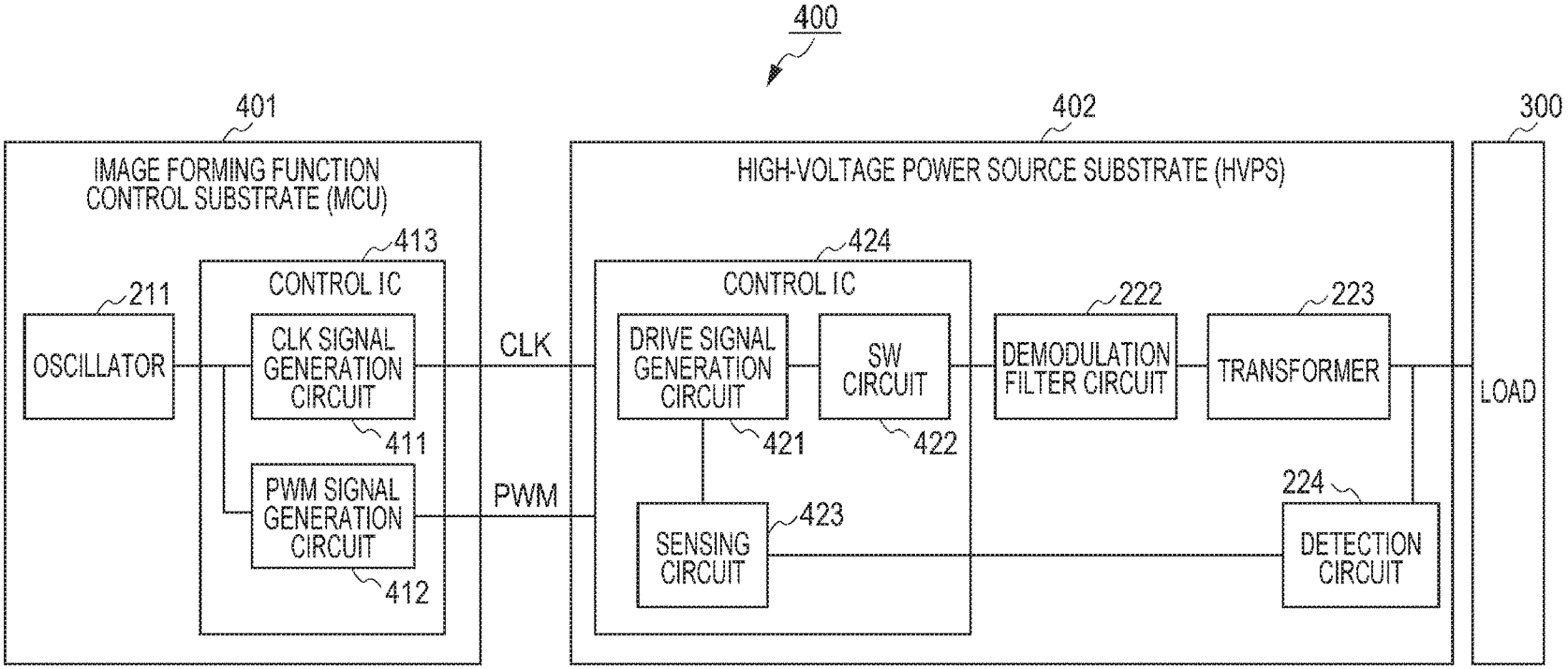
FIG. 6 is a block diagram illustrating a power source device according to a comparative example.

FIG. 6 is a diagram illustrating a power source device according to the related art.

In a power source device 400 according to the related art, as illustrated in FIG. 6, an image forming function control substrate (MCU) 401 is provided with a control IC 413 that has a clock signal generation circuit 411 and a PWM signal generation circuit 412. In addition, a power source substrate 402 is provided with a control IC 424 that has a drive signal generation circuit 421, a switching circuit 422, and a sensing circuit 413.

Therefore, as illustrated in FIG. 6, the power source device 400 according to the related art requires two integrated circuits for control and modulation signal generation, which incurs a cost increase. In the case where the image forming function control substrate (MCU) 401 and the power source substrate 402 are each provided with an integrated circuit, in addition, there occurs a technical issue that the power source substrate 402 is increased in size for the size of the integrated circuit itself and the presence of patterns on the substrate routed around the integrated circuit.

Second Exemplary Embodiment

Figure 7:
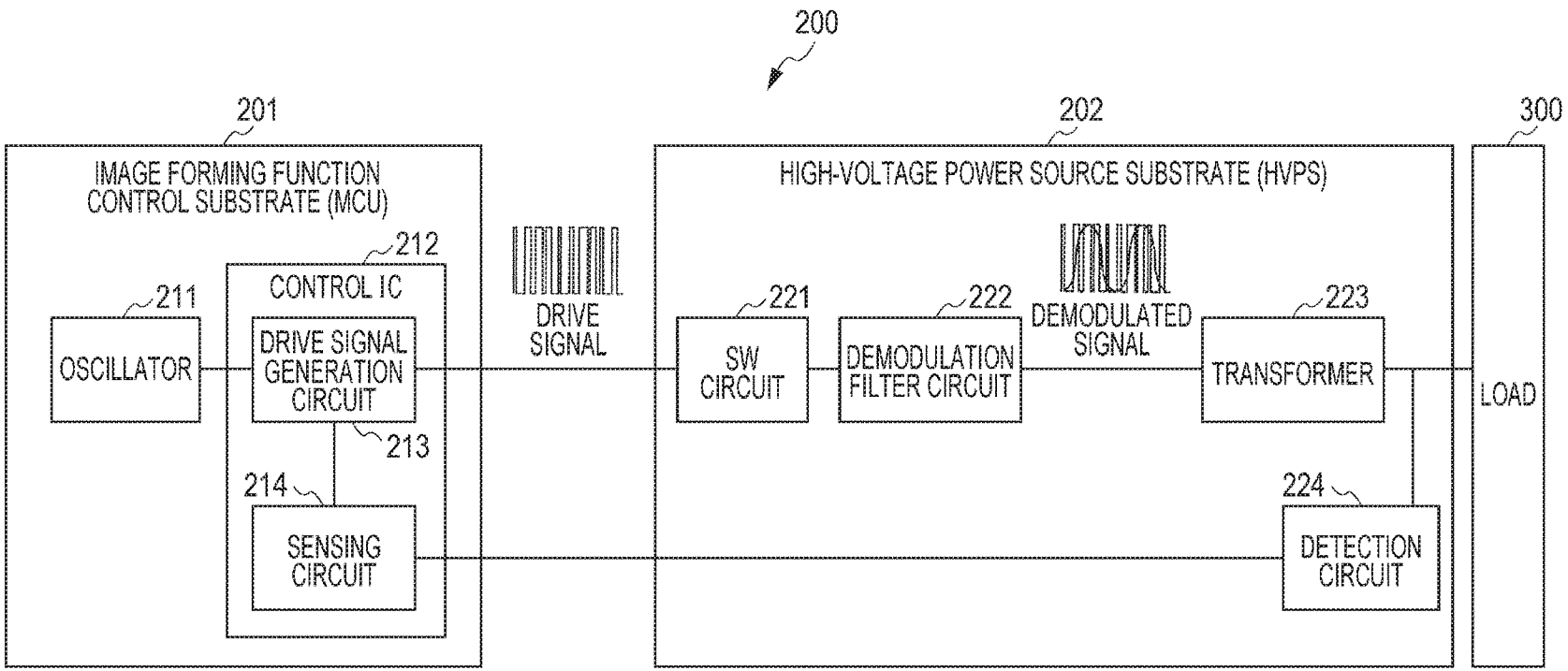
FIG. 7 is a block diagram illustrating a power source device according to a second exemplary embodiment of the present invention.

FIG. 7 is a block diagram illustrating a power source device according to a second exemplary embodiment.

In a power source device 200 according to the second exemplary embodiment, as illustrated in FIG. 7, a sensing circuit 214 of an image forming function control substrate (MCU) 201 is built in a control IC 212, rather than being constituted separately from the control IC 212.

Third Exemplary Embodiment

Figure 8:
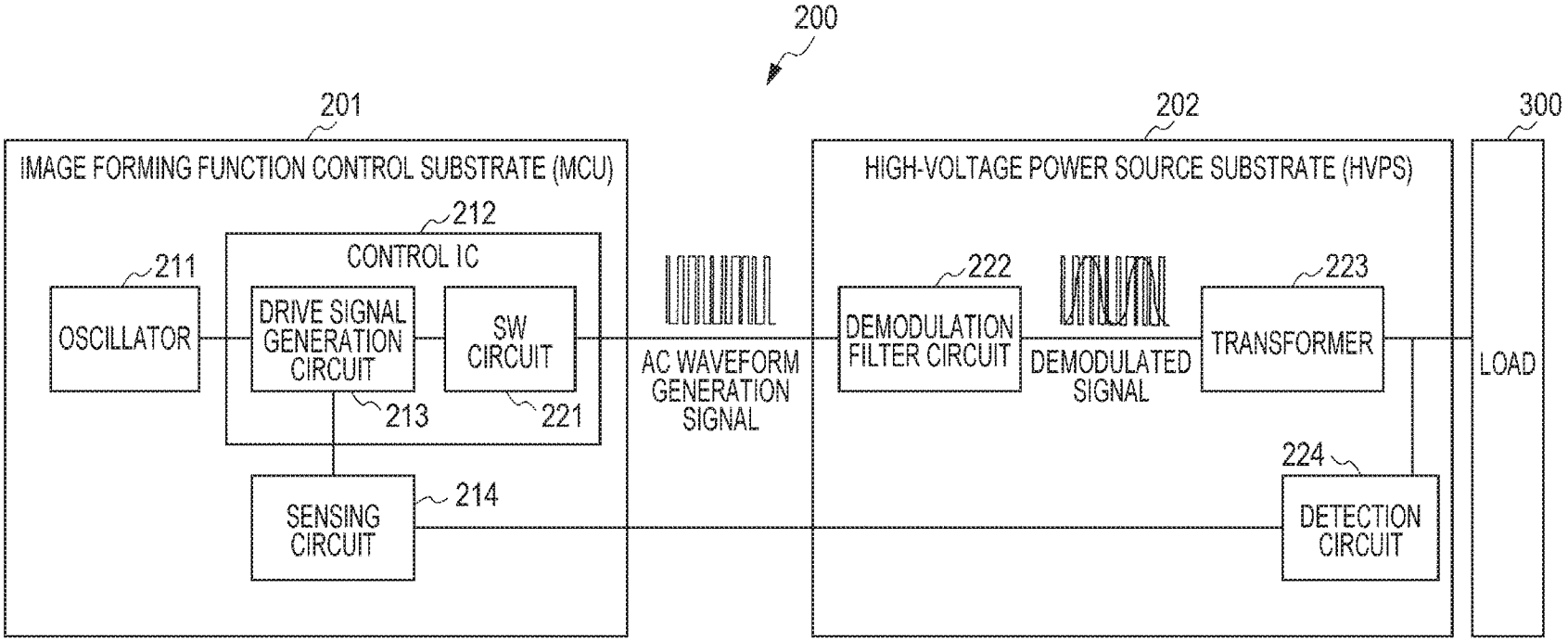
FIG. 8 is a block diagram illustrating a power source device according to a third exemplary embodiment of the present invention.

FIG. 8 is a block diagram illustrating a power source device according to a third exemplary embodiment.

In a power source device 200 according to the third exemplary embodiment, as illustrated in FIG. 8, a switching circuit 221 is built in a control IC 212 of an image forming function control substrate (MCU) 201, rather than being provided in a high-voltage power source substrate 202.

Fourth Exemplary Embodiment

Figure 9:
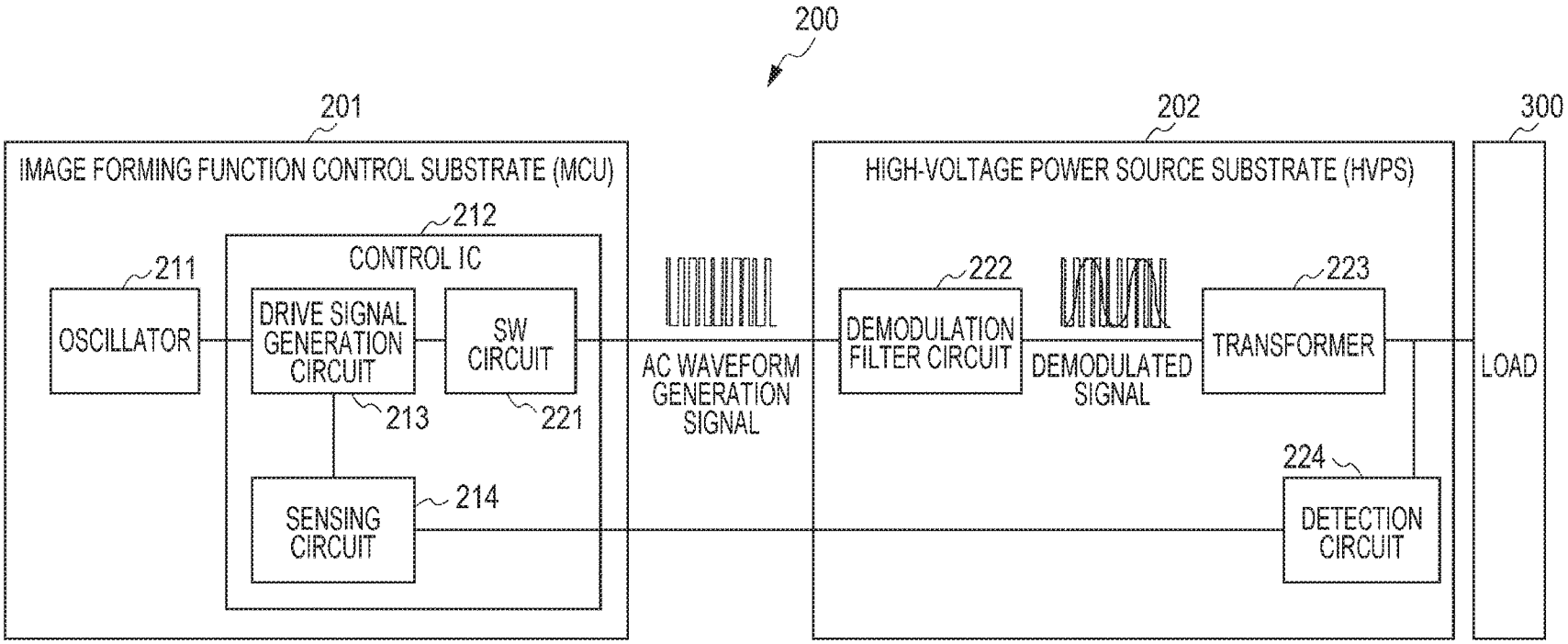
FIG. 9 is a block diagram illustrating a power source device according to a fourth exemplary embodiment of the present invention.

FIG. 9 is a block diagram illustrating a power source device according to a fourth exemplary embodiment.

In a power source device 200 according to the fourth exemplary embodiment, as illustrated in FIG. 9, a sensing circuit 214 of an image forming function control substrate (MCU) 201 is built in a control IC 212, rather than being constituted separately from the control IC 212, in contrast to the power source device 200 according to the third exemplary embodiment illustrated in FIG. 8.

In the exemplary embodiments described above, the present invention is applied to an image forming apparatus that forms a monochrome image. It is a matter of course, however, that the present invention is similarly applicable to a full-color image forming apparatus that forms a toner image in four colors, namely yellow (Y), magenta (M), cyan (C), and black (K).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A power source device comprising:

a control substrate that has a drive signal generating integrated circuit configured to output a drive signal modulated to generate an AC voltage; and a power source substrate configured to generate a high AC voltage by demodulating the drive signal which is output from the drive signal generating integrated circuit of the control substrate.

2. The power source device according to claim 1, further comprising:

a switching circuit configured to perform a switching operation in response to the drive signal which is output from the drive signal generating integrated circuit of the control substrate.

3. The power source device according to claim 2, wherein the switching circuit is provided on the power source substrate.

4. The power source device according to claim 2, wherein the switching circuit is provided on the control substrate.

5. The power source device according to claim 1, wherein the power source substrate includes a detection unit configured to detect the generated high AC voltage.

6. The power source device according to claim 5, wherein the control substrate is configured to input a detection signal from the detection unit.

7. The power source device according to claim 5, wherein the control substrate is configured to control the drive signal, which is generated by the drive signal generating integrated circuit, in response to a detection signal from the detection unit.

8. An image forming apparatus comprising:

an image forming member configured to receive a high AC voltage; and a power source device configured to output the high AC voltage to be supplied to the image forming member, wherein the power source device is the power source device according to claim 1.

9. The power source device according to claim 1, wherein the power source substrate is configured to generate the high AC voltage by demodulating the drive signal which is output from the drive signal generating integrated circuit of the control substrate and boosting the demodulated drive signal into the high AC voltage.

10. The power source device according to claim 1, wherein the power source substrate is configured without any controllers.

* * * * *